US007204633B2

(12) United States Patent
Yun

(10) Patent No.: US 7,204,633 B2
(45) Date of Patent: Apr. 17, 2007

(54) LAMP HOLDER AND LCD HAVING THE SAME

(75) Inventor: Tae Su Yun, Gumi-si (KR)

(73) Assignee: LG. Philips LCD Co., Ltd., Seoul (KR)

( * ) Notice: Subject to any disclaimer, the term of this patent is extended or adjusted under 35 U.S.C. 154(b) by 106 days.

(21) Appl. No.: 11/167,622

(22) Filed: Jun. 27, 2005

(65) Prior Publication Data

US 2006/0044813 A1 Mar. 2, 2006

(30) Foreign Application Priority Data

Aug. 31, 2004 (KR) ..... 10-2004-0069138

(51) Int. Cl.
*F21V 7/04* (2006.01)
*H01R 33/02* (2006.01)

(52) U.S. Cl. ..... 362/614; 362/260; 439/233

(58) Field of Classification Search ..... 362/614, 362/260, 217; 439/232–233; 349/70
See application file for complete search history.

(56) References Cited

U.S. PATENT DOCUMENTS 3,417,364 A * 12/1968 Kunkle et al. ..... 439/233
4,799,134 A * 1/1989 Pinch et al. ..... 362/217
5,063,486 A * 11/1991 Cummings et al. ..... 362/217
6,190,200 B1 * 2/2001 Burwell ..... 439/557
6,769,789 B1 * 8/2004 Won et al. ..... 362/260

FOREIGN PATENT DOCUMENTS

JP 2002237212 * 8/2002

* cited by examiner

*Primary Examiner*—Ali Alavi
(74) *Attorney, Agent, or Firm*—Brinks Hofer Gilson & Lione

(57) ABSTRACT

A lamp holder capable of minimizing lamp wire breakage, an LCD containing the inventive lamp holder, and a method for using the lamp holder to minimize lamp wire breakage and to facilitate connection of a lamp wire to a lamp are provided. The lamp holder includes: a lamp holder body having a coupling hole into which a lamp is inserted, the coupling hole having a first opening on one surface side and a second opening on a second surface side; a cut-away portion having a predetermined depth in a third surface side; and a stopper adjacent to the cut-away portion in the third surface side. The cut-away portion and the stopper facilitate connection of a lamp wire to a lamp in the lamp holder so as to minimize lamp wire breakage.

27 Claims, 9 Drawing Sheets

LAMP HOLDER AND LCD HAVING THE SAME

This application claims the benefit of priority to Korean Patent Application No. 69138/2004 filed on Aug. 31, 2004, herein incorporated by reference.

BACKGROUND OF THE INVENTION

1. Field of the Invention

The present invention relates to an inventive lamp holder capable of minimizing lamp wire breakage, an LCD containing the inventive lamp holder, and a method for using the lamp holder to minimize lamp wire breakage and to facilitate connection of a lamp wire to a lamp.

2. Description of the Related Art

A liquid crystal display device (LCD) exhibits electro-optical properties. That is, when a liquid crystal is injected between two transparent electrodes, transmittance of the liquid crystal is changed according to an electric field generated when a predetermined voltage is applied between two transparent electrodes. Accordingly, the LCD displays character, image, and moving picture.

However, although an LCD can adjust the transmittance of the liquid crystal, it cannot generate light by itself. Therefore, an LCD requires a light source enabling a user to recognize data processed by an information processor.

One way of providing light for operating an LCD is to utilize sunlight or light generated from an indoor lamp. An alternative approach is to utilize light generated from an electric energy source stored in the LCD itself. Both approaches have advantages and disadvantages.

Utilization of sunlight or light from an indoor lamp in an LCD can provide the advantage of effective, efficient power consumption. However, reliance on these light sources may preclude the ability of an LCD to display an image in a dark place.

When using light generated from electric energy sources stored in the LCD itself, significant power is consumed, however the LCD can display an image independent of the external environment. Accordingly, light from stored energy sources is widely utilized in most LCDs.

The second approach typically requires a device, such as a backlight unit, for generating light from the stored energy source. The backlight unit includes a lamp, a lamp wire for applying a voltage to the lamp, a lamp holder for holding the lamp connected with the lamp wire, and a lamp reflector for reflecting light radially generated from the lamp in a particular direction.

There is a need in the art for improved lamp holders and methods for preventing lamp wire breakage. Occasionally, the lamp holder is unable to absorb an external force so as to prevent lamp wire breakage, especially after soldering a lamp to the lamp wire in backlight unit. When a lamp wire is broken in a device, such as an LCD, the device cannot display an image, since voltage cannot be applied to the lamp.

FIG. 1 is a perspective view of a related art lamp holder. The related art lamp holder 200 includes a lamp holder body 230 with a hexahedron shape and lamp wire fixing parts 210 and 250.

The lamp holder body 230 fixes a lamp providing light to an LCD and a lamp wire connected to a lamp electrode. The lamp wire fixing parts 210 and 250 are lamp wire fixing tubes, each tube protruding with a predetermined height from an opening defined on a first surface 211. Each of the lamp wire fixing parts 210 and 250 has an inside diameter appropriately sized to accommodate the outside diameter of the lamp wire.

When an external force is applied to the lamp wire, for the purpose of fixing the lamp wire or moving the lamp wire within a lamp holder, the lamp wire fixing parts 210 and 250 may absorb stress at the boundary between the lamp holder body 230 and the lamp wire fixing parts 210 and 250 so as to prevent the lamp wire from breaking. However, a space is needed to facilitate fixing of the lamp wire and the lamp inside the lamp holder body 230.

FIG. 2 is a sectional view of the lamp holder shown in FIG. 1. Referring to FIG. 2, a coupling hole 220 inside the lamp holder body 230 is formed between a first surface or side 211 of the lamp holder body 230 and a second surface or side 215 adjacent to the first surface 211.

Here, the first surface 211 is a top surface of the lamp holder body 230 and the second surface 215 is a side surface of the lamp holder body 230. Accordingly, the coupling hole 220 has an L-shape and passes through the lamp holder body 230.

Referring to FIGS. 3 to 5, the coupling hole 220 has two openings 220*a* and 220*b*. A lamp 400 is inserted through the opening 220*a* formed on the second surface 215 (FIG. 4–5) and a lamp wire 300 is inserted through the opening 220*b* formed on the first surface 211 (FIG. 3–5).

Referring to FIG. 3, the lamp wire 300 is inserted into the opening 220*b* through the lamp wire fixing parts 210 and 250 disposed on the first surface 211 of the lamp holder body 230. Referring to FIG. 4, the lamp wire 300 passes through the opening 220*a* in the second surface 215 of the lamp holder body 230 and is soldered to a lamp 400 disposed outside the lamp holder 200.

Referring now to FIG. 5, the lamp wire 300 extending from the lamp wire fixing parts 210 and 250 is pulled to position the soldered portion inside the lamp holder body 230. When pulling the lamp wire 300, however, the lamp wire may be disconnected from the soldered portion. Moreover, a strong external force may damage the lamp itself.

SUMMARY OF THE INVENTION

Accordingly, the present invention is directed to a lamp holder and an LCD containing a lamp holder which can obviate one or more limitations or disadvantages exhibited in the related art. For example, the inventive lamp holder may reduce the probability that a lamp wire will be broken when an external force is applied.

Additional advantages, objects, and features of the invention are set forth in part in the description which follows and will be apparent to those having ordinary skill in the art upon examining the information contained herein. The objectives and advantages of the present invention may be realized or achieved with the embodiments set forth in the specification, claims, and appended drawings.

In one aspect, the present invention provides a lamp holder including: a lamp holder body; a coupling hole in the lamp holder body for securing a lamp, the coupling hole having a first opening at a first side of the lamp holder body and a second opening at a second side of the lamp holder body; a cut-away portion in the lamp holder body at a third side of the lamp holder body; and a stopper positioned in a resting position in a portion of the third side of the lamp holder body.

In another aspect of the present invention, an LCD is provided, wherein the LCD includes: a lamp; a lamp holder having: a lamp holder body; a coupling hole in the lamp holder body for securing a lamp, the coupling hole having a first opening at a first side of the lamp holder body and a second opening at a second side of the lamp holder body; a cut-away portion in the lamp holder body at a third side of the lamp holder body; and a stopper positioned in a resting position in a portion of the third side of the lamp holder body; and a liquid crystal panel for receiving light emitted from the lamp to display an image.

In a further aspect, a method for using the lamp holder of the present invention to facilitate and secure connection of lamp to a lamp wire in a lamp holder is provided. This method involves providing the inventive lamp holder of the present invention as described herein, inserting a lamp through a first opening, positioning a stopper in a first position to expose the lamp to the outside of the lamp holder through a cut-away portion, connecting a portion of a lamp to a lamp wire, and moving the stopper to a second position to position in the coupling hole a portion of the lamp connected to the lamp wire.

It is to be understood that both the foregoing general description and the following detailed description exemplify the present invention and are intended to illustrate the present invention as set forth in the specification, claims, and appended drawings.

BRIEF DESCRIPTION OF THE DRAWINGS

The accompanying drawings illustrate aspects and principles of the present invention.

DETAILED DESCRIPTION OF THE INVENTION

Reference to various preferred embodiments of the present invention will now be made, examples of which are illustrated in accompanying FIGS. 6–9. Wherever possible, the same reference numbers will be used throughout the drawings to refer to the same or like parts.

Figure 1:
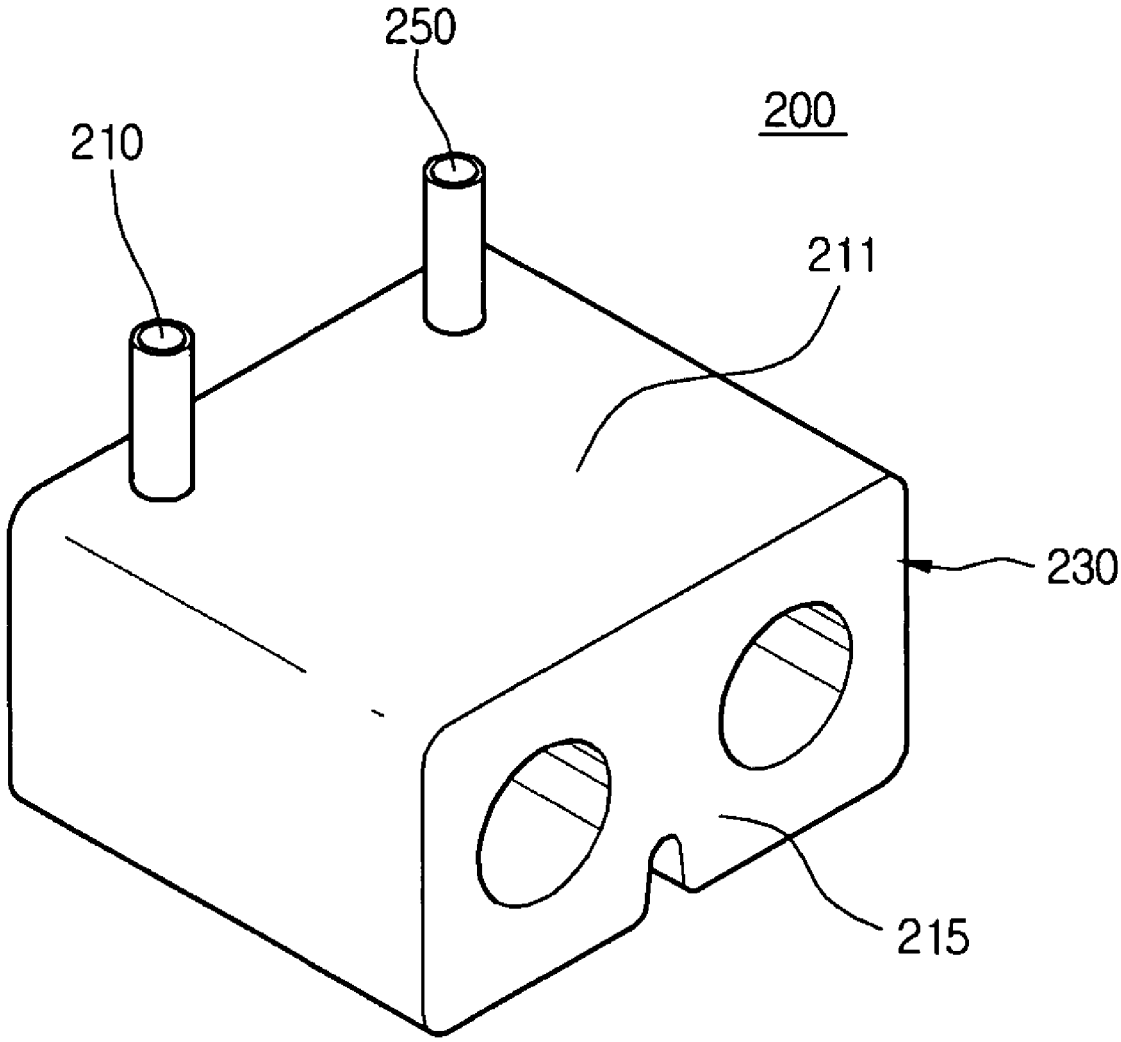
FIG. 1 is a perspective view of a related art lamp holder.
Figure 2:
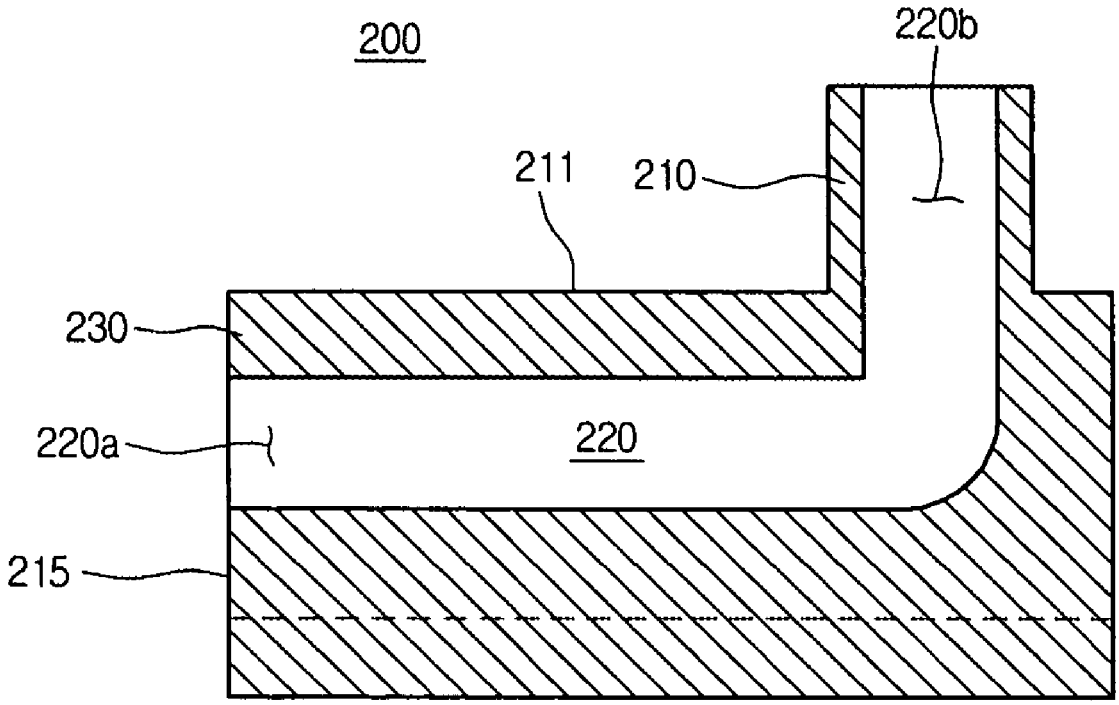
FIG. 2 is a sectional view of the lamp holder shown in FIG. 1.
Figure 3:
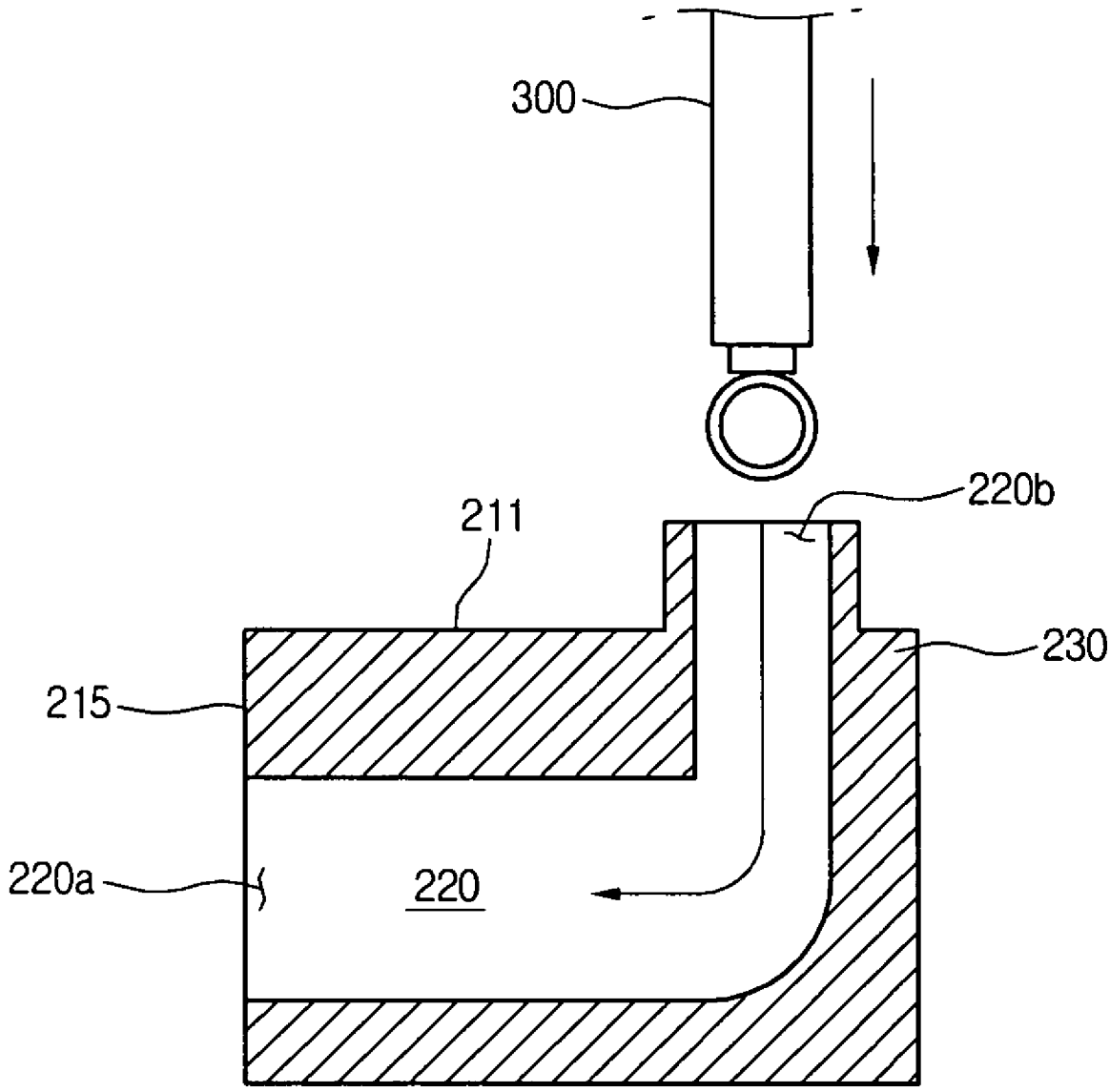
FIG. 3 is a sectional view illustrating insertion of a lamp wire into the lamp holder of FIG. 1.
Figure 4:
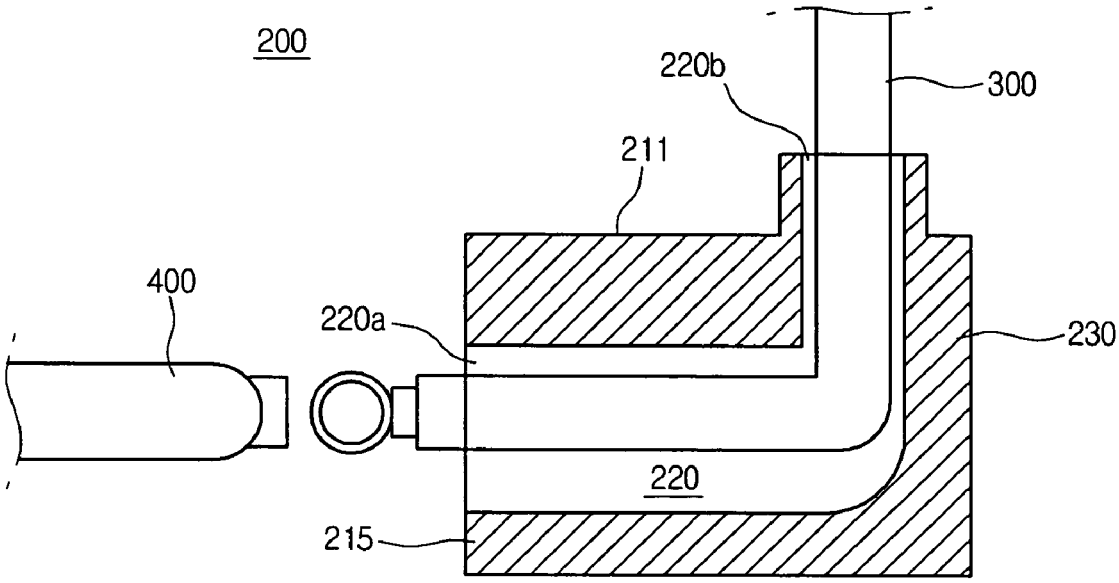
FIG. 4 is a sectional view illustrating connection of a lamp wire to lamp outside of the lamp holder of FIG. 1.
Figure 5:
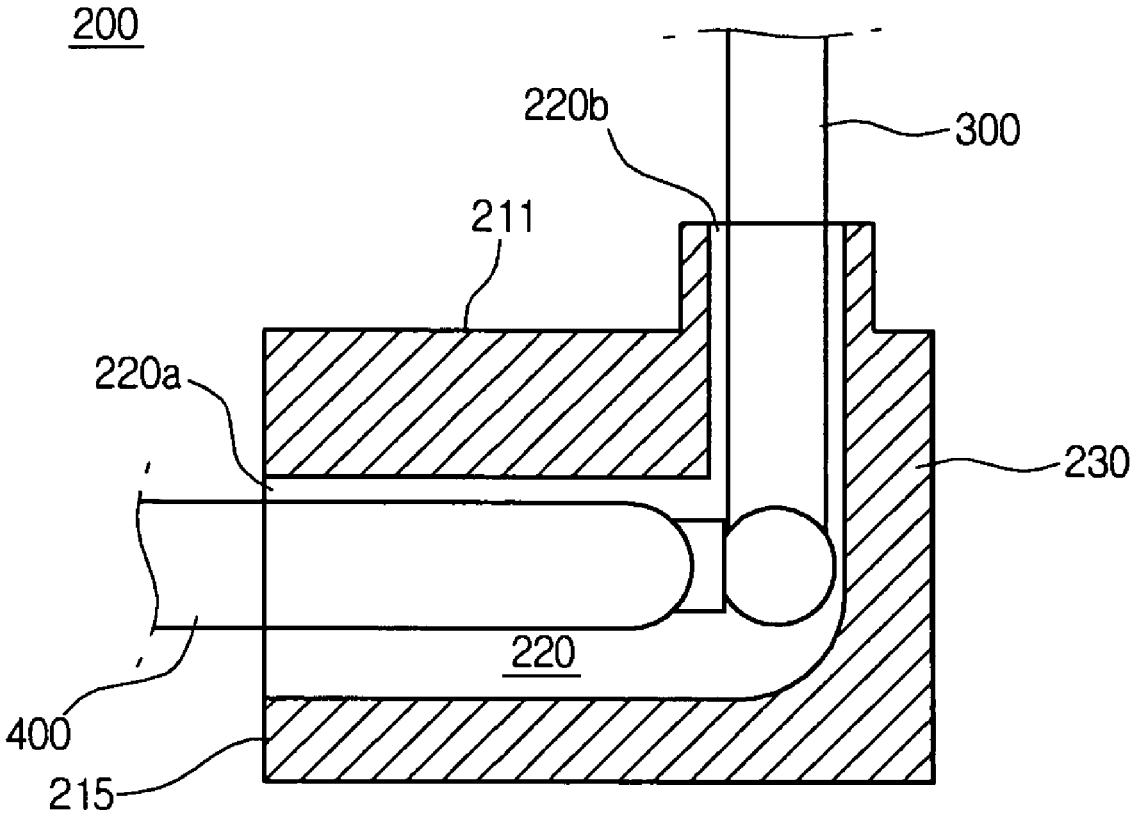
FIG. 5 is a sectional view illustrating an assembly of a lamp wire and a lamp inside the lamp holder of FIG. 1.
Figure 6:
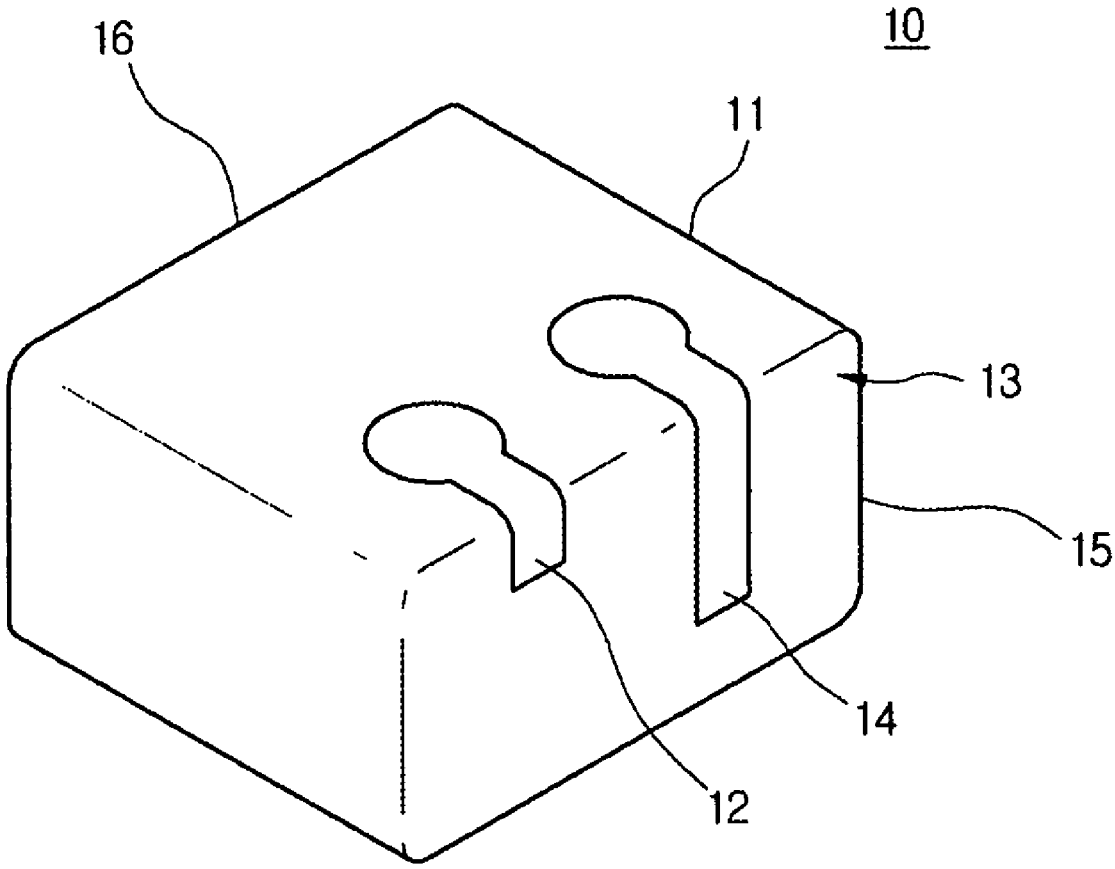
FIG. 6 is a perspective view of a lamp holder according to an embodiment of the present invention.
Figure 7:
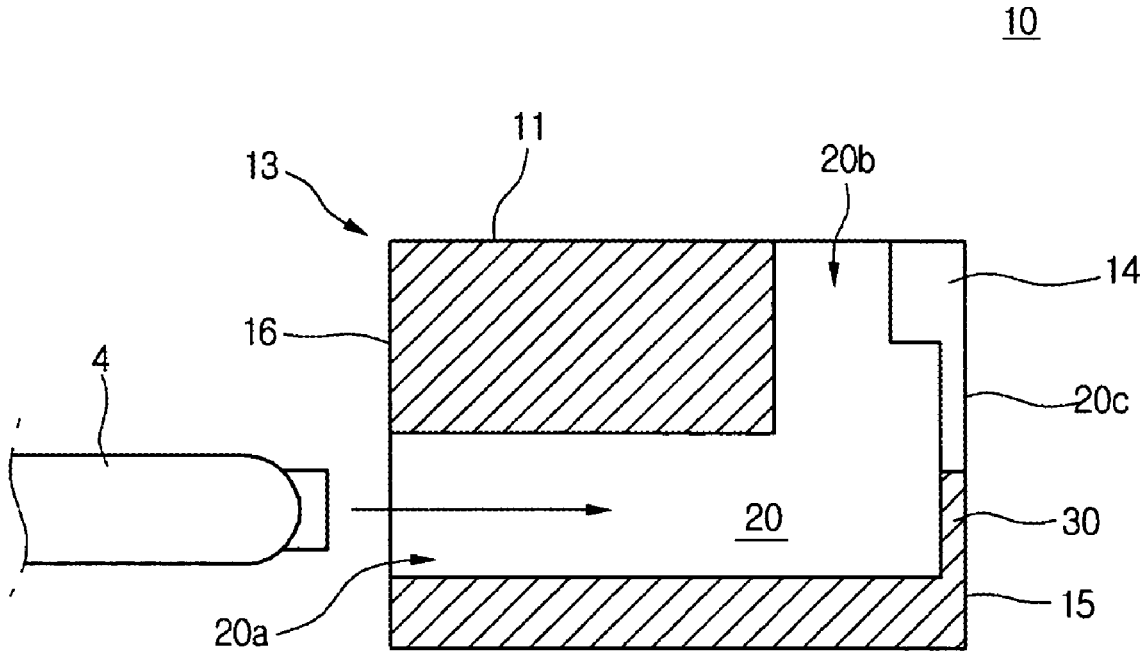
FIG. 7 is a sectional view of the lamp holder shown in FIG. 6.

FIG. 6 is a perspective view of a lamp holder 10 according to one embodiment of the present invention. FIG. 7 is a sectional view of the lamp holder shown in FIG. 6. The lamp holder 10 includes a lamp holder body 13 with one or more cut-away portions 12, 14.

The lamp holder body 13 fixes a lamp 4 connected to a lamp wire 3, the latter being connected to a lamp electrode. The lamp 4 may provide light for any suitable device requiring a light source, such as an LCD. The lamp holder body 13 may have a substantially hexahedron shape. However, the lamp holder body 13 is not limited by any particular three-dimensional shape. What is required is a minimum number of sides to accommodate one or more coupling holes 20, cut-away portions 14, and stoppers 30 suitable for fixedly connecting and securing a lamp 4 to a lamp wire 3 in a coupling hole within a lamp holder body 13 in accordance with the present invention.

The lamp holder body 13 has at least one cut-away portion 14. The cut-away portion 14 provides a third opening in a surface 15 in which the stopper 30 resides. The cut-away portion 14 may be formed by cutting away or removing a portion of the lamp holder 10 from a surface 15 in the direction of the opening 20*a* in a surface 16 through which the lamp 4 is inserted. Alternatively, the cut-away portion may merely represent an incompletely filled surface at least partially continuous with the coupling hole. The cut-away portion 14 or third opening 20*c* may be independent of or continuous with an opening 20*b* in adjoining surface 11.

In a preferred embodiment, the lamp holder body 13 has two cut-away portions 12 and 14 with different depths formed over one edge of the lamp holder body 13 as illustrated in FIG. 6. Preferably, the two cut-away portions 12 and 14 are formed over one edge of the lamp holder body 13. This design is useful for insertion of a lamp into coupling hole when the lamp is disposed in an oblique direction.

Referring now to FIG. 7, a coupling hole 20 in the lamp holder body 13 is formed between a first surface 11 of the lamp holder body 13 and a second surface 16 adjacent to the first surface 11. The coupling hole 20 fixes a lamp wire 3 connected to a lamp 4.

Depending on the orientation of lamp holder body 13, the first surface 11 may be a top, bottom or side surface of lamp holder body 13; similarly the second surface 16 adjoined to the first surface may be a top, bottom or side surface of lamp holder body 13, depending on the orientation of the lamp holder body 13. In the case, the coupling hole 20 has an L-shape and passes through the lamp holder body 13.

The coupling hole 20 has at least two openings, 20*a* and 20*b*, connecting at least two surfaces, 11 and 16. The cut-away portion 14 forms a third opening 20*c* in a surface 15 adjacent to the stopper 30 that may be independent of or continuous with an opening 20*b* in adjoining surface 11.

In FIG. 7, the lamp 4 is inserted through an opening 20*a* in side surface 16. A stopper 30 is formed at a lower portion of a third surface 15. The stopper 30 facilitates connection of the lamp 4 to a lamp wire 3 and helps to secure a connected portion of the lamp 4 to the lamp wire 3 in the lamp holder 10 after connecting the lamp 4 to the lamp wire 3.

The lamp holder 10, lamp holder body 13, or portions thereof are preferably made from or include elastic materials, such as a rubber or other suitable polymeric, elastomeric materials. However, any material suitable for fixing a lamp 4 and lamp wire 3 in a lamp holder 10 may be used according to the objectives and operation of the present invention.

The present invention further provides a method for using the lamp holder of the present invention to facilitate and secure fixing of a lamp 4 connected to a lamp wire 3 in a lamp holder 10. This method involves providing the inventive lamp holder of the present invention as described herein; inserting a lamp through an opening into the coupling hole; moving or bending the stopper from a resting position; moving the lamp to the outside of the lamp holder through the cut-away portion; connecting a portion of a lamp to a lamp wire; and restoring the stopper in a resting position.

Figure 8:
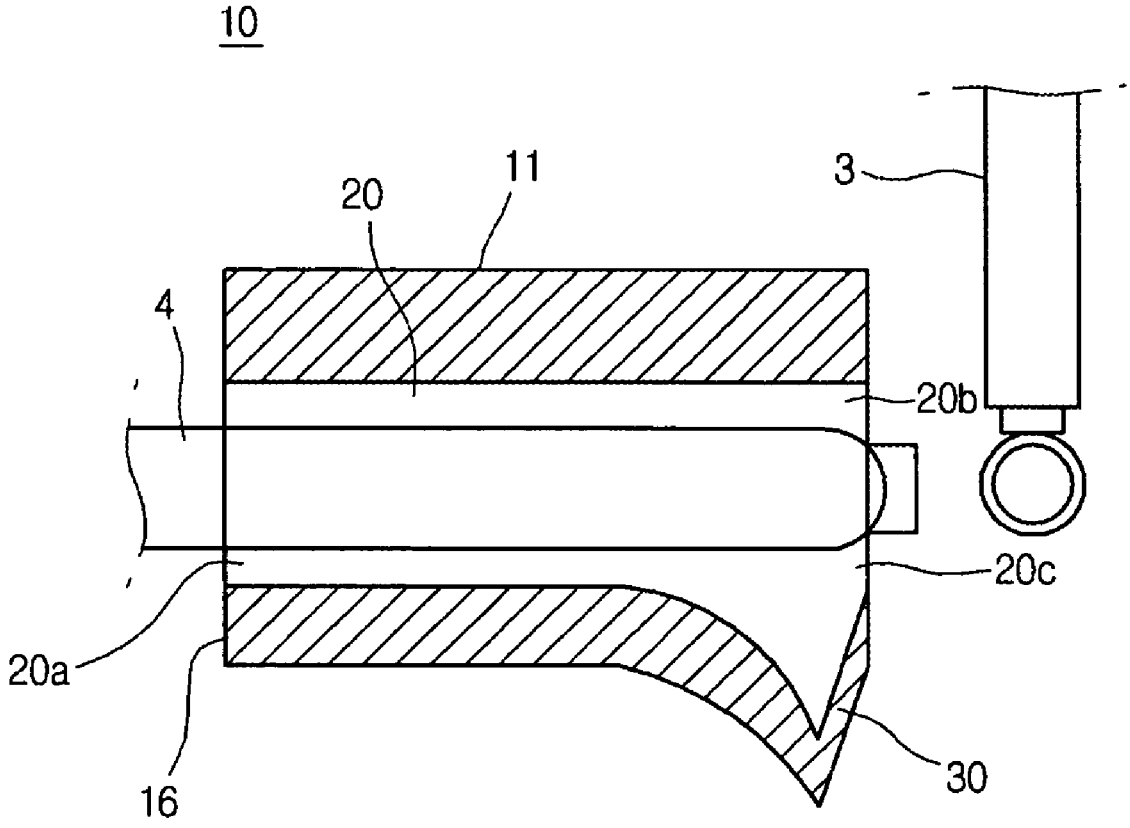
FIG. 8 is a sectional view illustrating a process for connecting a lamp wire to a lamp using the lamp holder of FIG. 6.

FIG. 8 is a sectional view of the lamp holder of FIGS. 6 and 7 being used according to the present invention. Herein the lamp 4 is inserted through an opening 20*a* in the second surface 16 of the lamp holder body 13. Exposure of the lamp 4 to the outside of the lamp holder body 13 is initially precluded by the position of the stopper 30. However, when the stopper 30 is bent downward, the cut-away portion 14 increases the size of an opening 20*c* on the third surface 15, thereby exposing the lamp to the outside of the lamp holder body 13. Exposure of the lamp 4 to the outside conveniently facilitates soldering of the lamp wire 3 to the exposed portion of the lamp 4.

Figure 9:
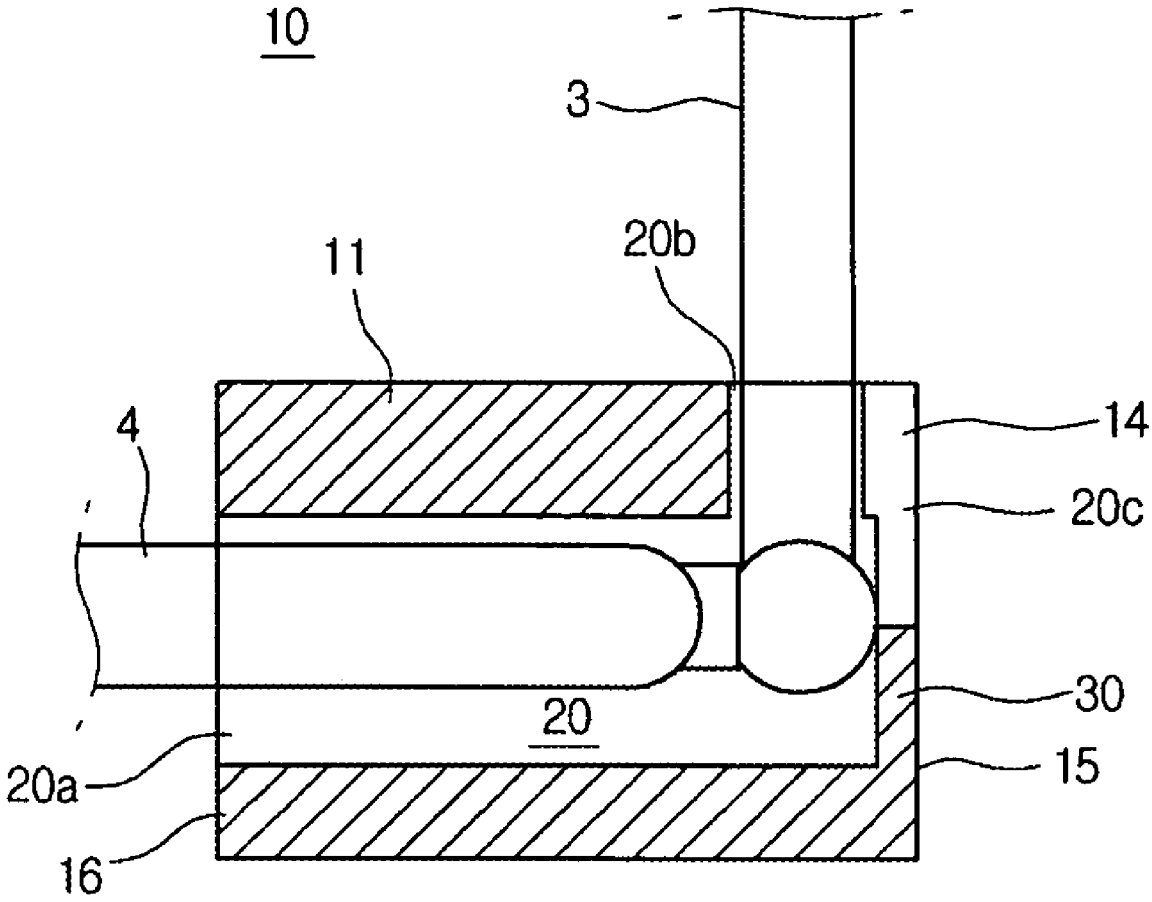
FIG. 9 is a sectional view of an assembly of a lamp wire and a lamp inside the lamp holder of FIG. 6.

FIG. 9 is a sectional view of the lamp holder after soldering a lamp 4 to a lamp wire 3 supplying voltage to the lamp 4. After the soldering step has been completed, the stopper 30 is restored to its original position. This causes the connected lamp wire 3 to translocate through the opening 20*b* formed on the first surface 11 of the lamp holder 10. The portion of the lamp 4 soldered to the lamp wire 3 is now positioned within the coupling hole 20.

Use of the stopper 30 reduces the need for applying a force to pull a lamp 4 soldered to a lamp wire 3 though a coupling hole 20. Accordingly, use of the lamp holder can minimize breakage of the lamp wire 3, which can occur after soldering a lamp 4 to a lamp wire 3 when using a lamp holder 200 according to FIGS. 1–5. The lamp holder design of the present invention further simplifies the process of connecting the lamp 4 to the lamp wire 3, can reduce work time and/or reduce the need to repeat or reinitiate the soldering process.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A lamp holder comprising:

a lamp holder body;

a coupling hole in the lamp holder body for securing a lamp, the coupling hole having a first opening at a first side of the lamp holder body and a second opening at a second side of the lamp holder body;

a cut-away portion in the lamp holder body at a third side of the lamp holder body; and a stopper positioned in a resting position in a portion of the third side of the lamp holder body.

2. The lamp holder of claim 1, wherein the lamp holder comprises an elastic material.

3. The lamp holder of claim 1, wherein the lamp holder comprises a rubber material.

4. The lamp holder of claim 1, wherein the coupling hole comprises a lamp.

5. The lamp holder of claim 4, wherein the lamp is connected to a lamp wire.

6. The lamp holder of claim 1, wherein the cut-away portion forms a third opening.

7. The lamp holder of claim 6, wherein the third opening is continuous with the second opening.

8. The lamp holder of claim 1, wherein the cut-away portion is immediately adjacent to the stopper.

9. The lamp holder of claim 1, wherein the stopper is capable of selectively blocking a lamp in a coupling hole from being translocated out of the lamp holder body when the stopper is in the resting position.

10. The lamp holder of claim 1, wherein moving or bending the stopper from the resting position facilitates coupling between a lamp and a lamp wire.

11. The lamp holder of claim 1, wherein moving or bending the stopper from the resting position can expose a lamp in the coupling hole to the outside of the lamp holder body.

12. The lamp holder of claim 6, wherein moving or bending the stopper from the resting position increases the size of the third opening.

13. A liquid crystal display device comprising:

a lamp;

a lamp holder comprising:

a lamp holder body;

a coupling hole in the lamp holder body for securing a lamp, the coupling hole having a first opening at a first side of the lamp holder body and a second opening at a second side of the lamp holder body;

a cut-away portion in the lamp holder body at a third side of the lamp holder body; and a stopper positioned in a resting position in a portion of the third side of the lamp holder body; and a liquid crystal panel for receiving light emitted from the lamp to display an image.

14. The liquid crystal display device of claim 13, wherein the lamp holder comprises an elastic material.

15. The liquid crystal display device of claim 13, wherein the lamp holder comprises a rubber material.

16. The liquid crystal device of claim 13, wherein the lamp is connected to a lamp wire.

17. The liquid crystal device of claim 13, wherein the cut-away portion forms a third opening.

18. The liquid crystal device of claim 17, wherein the third opening is continuous with the second opening.

19. The liquid crystal device of claim 13, wherein the cut-away portion is immediately adjacent to the stopper.

20. The liquid crystal device of claim 13, wherein the stopper is capable of selectively blocking a lamp in a coupling hole from being translocated out of the lamp holder body when the stopper is in a resting position.

21. The liquid crystal device of claim 13, wherein moving or bending the stopper from the resting position facilitates coupling between a lamp and a lamp wire.

22. The liquid crystal device of claim 13, wherein moving or bending the stopper from the resting position can expose a lamp in the coupling hole to the outside of the lamp holder body.

23. The liquid crystal device of claim 17, wherein moving or bending the stopper from the resting position increases the size of the third opening.

24. A method for providing to a lamp holder a lamp connected to a lamp wire comprising:

a) providing a lamp holder, the lamp holder including a lamp holder body, a coupling hole in the lamp holder body, a cut-away portion and a stopper;

wherein the coupling hole has a first opening at a first side of the lamp holder body and a second opening at a second side of the lamp holder body;

wherein the cut-away portion has a predetermined depth in a surface of a third side of the lamp holder body; and wherein the stopper is positioned in a resting position in a portion of the third side of the lamp holder body;

b) inserting a lamp through an opening into the coupling hole;

c) moving or bending the stopper from a resting position;

d) moving the lamp to the outside of the lamp holder through the cut-away portion;

e) connecting a portion of the lamp to a lamp wire; and f) restoring the stopper to the resting position.

25. The method of claim 24, wherein moving or bending the stopper from the resting position increases the size of an opening in a portion of the third side of the lamp holder body.

26. The method of claim 24, wherein moving or bending the stopper from the resting position increases the size of an opening in a portion of the third side of the lamp holder body that is continuous with the second opening at the second side of the lamp holder body.

27. The method of claim 24, wherein restoring the stopper to the resting position causes an end portion of lamp wire connected to the lamp to translocate through the second opening at the second side of the lamp holder body.

* * * * *